US010975683B2

(12) United States Patent
Adams et al.

(10) Patent No.: US 10,975,683 B2
(45) Date of Patent: Apr. 13, 2021

(54) CORING TOOLS ENABLING MEASUREMENT OF DYNAMIC RESPONSES OF INNER BARRELS AND RELATED METHODS

(71) Applicant: Baker Hughes Holdings LLC, Houston, TX (US)

(72) Inventors: Nathaniel R. Adams, Spring, TX (US); Jason R. Habernal, Magnolia, TX (US); Jeremy S. Robichaux, Rayne, LA (US)

(73) Assignee: Baker Hughes Holdings LLC, Houston, TX (US)

( * ) Notice: Subject to any disclaimer, the term of this patent is extended or adjusted under 35 U.S.C. 154(b) by 156 days.

(21) Appl. No.: 15/891,930

(22) Filed: Feb. 8, 2018

(65) Prior Publication Data

US 2019/0242240 A1 Aug. 8, 2019

(51) Int. Cl.

| | |
|---|---|
| ***E21B 47/01*** | (2012.01) |
| ***E21B 25/10*** | (2006.01) |
| ***E21B 10/02*** | (2006.01) |

(52) U.S. Cl.

CPC ..... *E21B 47/01* (2013.01); *E21B 10/02* (2013.01); *E21B 25/10* (2013.01)

(58) Field of Classification Search

CPC ..... E21B 25/00; E21B 47/01; E21B 10/02

See application file for complete search history.

(56) References Cited

U.S. PATENT DOCUMENTS

| | | | | |
|---|---|---|---|---|
| 3,363,703 A * | 1/1968 | Shewmake | ..... | E21B 25/16 175/44 |
| 4,492,275 A * | 1/1985 | Campbell | ..... | E21B 25/00 174/46 |
| 4,499,955 A * | 2/1985 | Campbell | ..... | E21B 12/02 175/46 |
| 4,499,956 A * | 2/1985 | Campbell | ..... | E21B 12/02 175/46 |
| 4,601,354 A * | 7/1986 | Campbell | ..... | E21B 12/02 175/46 |
| 6,006,844 A * | 12/1999 | Van Puymbroeck | ... | E21B 47/12 175/50 |
| 6,220,371 B1 | 4/2001 | Sharma et al. | | |

(Continued)

FOREIGN PATENT DOCUMENTS

WO 2016/176153 A1 11/2016

OTHER PUBLICATIONS

International Written Opinion for International Application No. PCT/US2019/017099 dated May 28, 2019, 6 pages.

(Continued)

*Primary Examiner* — Jennifer H Gay
(74) *Attorney, Agent, or Firm* — TraskBritt

(57) ABSTRACT

Coring tools for procuring core samples from an earth formations may include an inner barrel and an outer barrel located around, and rotatable with respect to, the inner barrel. A coring bit may be affixed to an end of the outer barrel. A sensor module may be rotationally secured to the inner barrel. The sensor module may include at least one sensor configured to measure a dynamic response of the inner barrel during a coring process and a nontransitory memory operatively connected to the at least one sensor, the nontransitory memory configured to store data generated by the at least one sensor.

9 Claims, 2 Drawing Sheets

(56) References Cited

U.S. PATENT DOCUMENTS

| | | | | |
|---|---|---|---|---|
| 7,878,269 | B2 * | 2/2011 | Cravatte | E21B 49/02 175/44 |
| 8,100,196 | B2 | 1/2012 | Pastusek et al. | |
| 8,146,684 | B2 * | 4/2012 | Cravatte | E21B 49/02 175/44 |
| 8,297,376 | B2 * | 10/2012 | Cravatte | E21B 49/02 175/44 |
| 8,689,903 | B2 | 4/2014 | Beuershausen et al. | |
| 8,797,035 | B2 * | 8/2014 | Bittar | E21B 47/102 324/333 |
| 2005/0199393 | A1 * | 9/2005 | Goldberg | E21B 47/18 166/254.2 |
| 2008/0156537 | A1 * | 7/2008 | Stockton | E21B 25/00 175/58 |
| 2009/0078467 | A1 * | 3/2009 | Castillo | E21B 25/10 175/249 |
| 2009/0159335 | A1 * | 6/2009 | Cravatte | E21B 25/00 175/40 |
| 2009/0166088 | A1 * | 7/2009 | Jeffryes | E21B 10/00 175/41 |
| 2010/0000108 | A1 * | 1/2010 | Stockton | E21B 25/00 33/501.02 |
| 2011/0083905 | A1 * | 4/2011 | Cravatte | E21B 25/00 175/239 |
| 2012/0145461 | A1 * | 6/2012 | Cravatte | E21B 25/00 175/58 |
| 2012/0234607 | A1 | 9/2012 | Kinsella | |
| 2013/0113487 | A1 * | 5/2013 | Bittar | G01N 27/025 324/333 |
| 2013/0199847 | A1 * | 8/2013 | Delmar | E21B 25/00 175/44 |
| 2015/0021097 | A1 * | 1/2015 | Wesemeier | E21B 25/08 175/59 |
| 2015/0191985 | A1 * | 7/2015 | Berger | E21B 25/08 175/24 |
| 2017/0306713 | A1 * | 10/2017 | Connell | E21B 25/16 |
| 2019/0063157 | A1 * | 2/2019 | Gao | E21B 7/00 |
| 2019/0242240 | A1 * | 8/2019 | Adams | E21B 10/02 |

OTHER PUBLICATIONS

International Search Report for International Application No. PCT/US2019/017099 dated May 28, 2019, 3 pages.

* cited by examiner

CORING TOOLS ENABLING MEASUREMENT OF DYNAMIC RESPONSES OF INNER BARRELS AND RELATED METHODS

FIELD

This disclosure relates generally to coring tools for forming core samples from earth formations and methods of making such coring tools. More specifically, disclosed embodiments relate to coring tools that may enable users to more easily analyze the behavior of the coring tools and components thereof during use.

BACKGROUND

When exploring a subterranean formation for desired resources, such as, for example, oil, gas, and water, a coring tool may be employed to procure a core sample from the subterranean formation. Typically, the coring tool includes an outer barrel having a coring bit secured to an end of the outer barrel. The outer barrel may be rotated and axial loads (e.g., weight on bit) may be transmitted from the outer barrel to the coring bit to drive the coring bit into an underlying earth formation. The coring bit may include a bore at or near a center of the coring bit, such that the coring bit may remove earthen material from around a cylindrical core sample. As the coring bit advances, the core sample may be received into an inner barrel located within the outer barrel. The outer barrel may be rotatable with respect to the inner barrel, such that the inner barrel may remain at least substantially stationary while the core sample is received therein.

During the coring process, the inner barrel may occasionally exhibit undesirable behaviors that may reduce the quality of the core sample. For example, downhole vibrations, unintended rotation of the inner barrel, contact or other interaction with the outer barrel, and lateral displacement of the inner barrel may cause the inner barrel to contact or otherwise interact with the core sample. Such contact may damage or contaminate the core sample, reducing its value as a representative sample of the earth formation.

BRIEF SUMMARY

In some embodiments, coring tools for procuring core samples from an earth formations may include an inner barrel and an outer barrel located around, and rotatable with respect to, the inner barrel. A coring bit may be affixed to an end of the outer barrel. A sensor module may be rotationally secured to the inner barrel. The sensor module may include at least one sensor configured to measure a dynamic response of the inner barrel during a coring process and a nontransitory memory operatively connected to the at least one sensor, the nontransitory memory configured to store data generated by the at least one sensor.

In other embodiments, methods of making coring tools for procuring core samples from earth formations may involve placing an inner barrel within an outer barrel, and rendering the outer barrel rotatable with respect to the inner barrel. A coring bit may be affixed to an end of the outer barrel. A sensor module may be rotationally secured to the inner barrel. The sensor module may include at least one sensor configured to measure a dynamic response of the inner barrel during a coring process and a nontransitory memory operatively connected to the at least one sensor, the nontransitory memory configured to store data generated by the at least one sensor.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular coring tool, sensor module and associated housing, or component thereof, but are merely idealized representations employed to describe illustrative embodiments. Thus, the drawings are not necessarily to scale.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

Disclosed embodiments relate generally to coring tools that may enable users to more easily analyze the behavior of the coring tools and components thereof during use. More specifically, disclosed are embodiments of coring tools that may include sensor modules rotationally secured to inner barrels of the coring tools, which may enable better analysis of the dynamic response of the inner barrel during a coring process.

Figure 1:
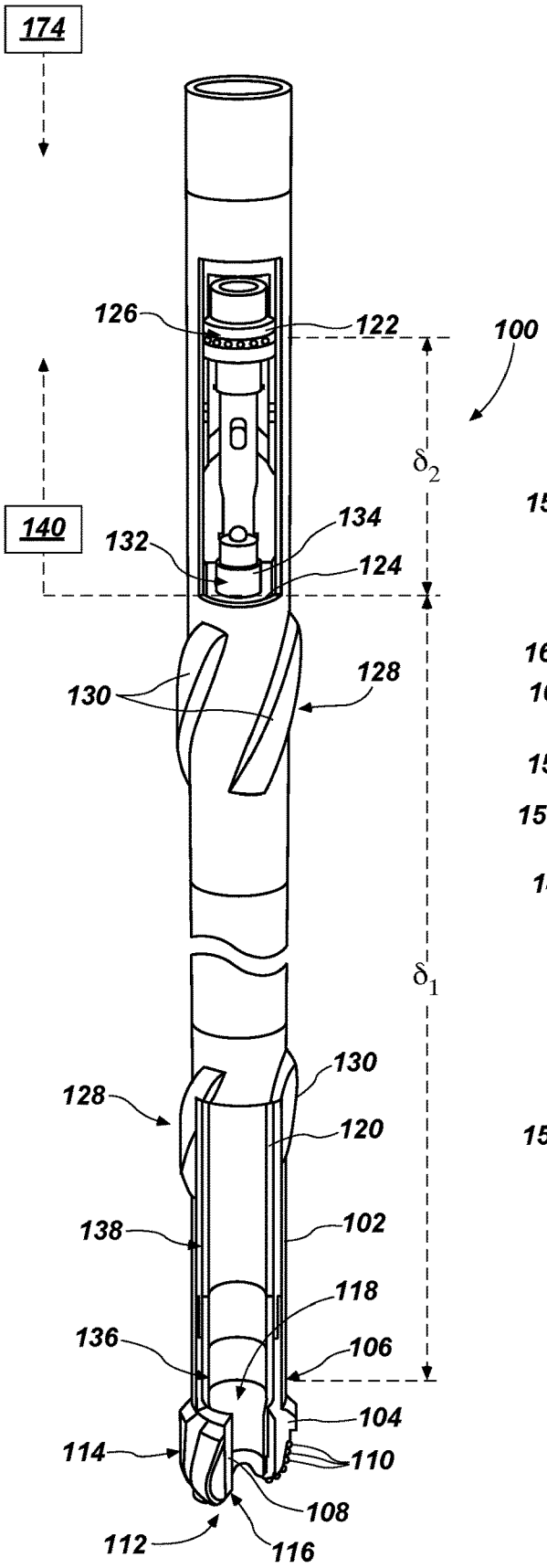
FIG. 1 is a partial cutaway, perspective side view of a coring tool for procuring a core sample from an earth formation.

FIG. 1 is a partial cutaway, perspective side view of a coring tool 100 for procuring a core sample from an earth formation. The coring tool 100 may include an outer barrel 102 and a coring bit 104 affixed to a leading end 106 of the outer barrel 102. The outer barrel 102 may include a tubular member configured to transmit rotational and axial forces to the coring bit 104, causing the coring bit 104 to rotate and advance into an earth formation. In some embodiments, such as that shown in FIG. 1, the outer barrel 102 may include one or more stabilizers 128 including blades 130 extending laterally outward from a remainder of the outer barrel 102. The blades 130 are configured to contact and slide against a sidewall of a borehole during a coring process. The blades 130 may be rotationally spaced from one another to enable fluids (e.g., drilling fluid) and solids suspended therein (e.g., cuttings of earth material) to travel across the stabilizers 128 during a coring process. The coring bit 104 may include a body 108 and cutting elements 110 affixed to the body 108. The cutting elements 110 may be distributed over a face 112 of the coring bit 104 from an outer gage 114 at a radially outermost extent of the body 108 to an inner gage 116 at a radially innermost extent of the body 108. The inner gage 116 may be located proximate to a bore 118 extending longitudinally through the body 108, and a core sample may be received into the bore 118 as the coring bit 104 advances into an earth formation and removes the surrounding earth material utilizing the cutting elements 110.

The coring tool 100 may further include an inner barrel 120 located within, and at least substantially rotationally stationary with respect to, the outer barrel 102. The inner barrel 120 may be or include another tubular member sized and shaped to receive the core sample as the core sample advances from the coring bit 104 farther into the coring tool 100. Rendering the outer barrel 102 rotatable with respect to the inner barrel 120 enables the inner barrel 120 to remain at least substantially stationary as the outer barrel 102 is rotated and a core sample advances into the inner barrel 120. Maintaining the inner barrel 120 at least substantially stationary during the coring process reduces the likelihood that that the core sample will be damaged by movement of the inner barrel 120 relative to the core sample. The inner barrel 120 may be suspended from a swivel assembly 122 at an end 124 of the inner barrel 120 opposite the coring bit 104. More specifically, an end of the swivel assembly 122 located distal from the coring bit 104 may be secured to, and rotatable with, the outer barrel 102. An end of the swivel assembly 122 located proximate to the coring bit 104 may be secured indirectly to the inner barrel 120. The swivel assembly 122 may include a bearing 126 located between its ends such that the likelihood that rotation of the outer barrel 102 is translated to rotation of the inner barrel 120 is reduced (e.g., minimized or eliminated).

The coring tool 100 may also include a sensor module 132 rotationally secured to the inner barrel 120. The sensor module 132 may be located between the swivel assembly 122 and the inner barrel 120. For example, the sensor module 132 may be located proximate to the end 124 of the inner barrel 120 located opposite the coring bit 104. More specifically, the sensor module 132 may be supported by a housing 134 interposed between, and directly affixed to, the swivel assembly 122 and the end 124 of the inner barrel 120. Spatial constraints may render placing sensor modules 132 on and in coring tools difficult, and particularly so when attempting to measure the dynamic response of the inner barrel 120. For example, the lateral dimensions of the coring tool 100 may be constrained by the size of the borehole in which the coring tool 100 may be inserted, and operators may generally desire to obtain as large a core sample as feasible, rendering the lateral space available for components of the coring tool 100 limited without any added sensor modules 132. As another example, there may be little longitudinal space to accommodate a sensor module 132 because the longitudinal space proximate to the radial periphery of the coring tool 100 may be occupied by structural components, such as, for example, the outer barrel 102 and the inner barrel 120, and the longitudinal space proximate to the radial center of the coring tool 100 may remain vacant to enable the core sample to enter the inner barrel 120. Continuing the example, the general desire to obtain as large a core sample as feasible may also limit the longitudinal space available for placement of a sensor module 132 in the coring tool 100.

The space for accommodating a sensor module 132 configured to measure the dynamic response of the inner barrel 120 may be particularly limited. For example, the inner barrel 120 may be contained within the outer barrel 102, drilling fluid may flow in an annular space 138 between the inner barrel 120 and the outer barrel 102 to cool and lubricate the coring bit 104, and a leading end 136 of the inner barrel 120 located proximate to the coring bit 104 may need to be free of occupying material to enable the core sample to enter the inner barrel 120. The placement of the sensor module 132, and the housing 134 facilitating such placement, may enable more complete detection of the dynamics of the inner barrel 120, without impeding advancement of the core sample into the inner barrel 120, at least substantially without interfering with operation of any other component or components of the coring tool 100.

A shortest distance $d_1$ between the sensor module 132 and the coring bit 104 may be, for example, at least about 25 feet (~7.6 m) to accommodate a length of a core sample received in the inner barrel 120. More specifically, the shortest distance $d_1$ between the sensor module 132 and the coring bit 104 may be, for example, between about 25 feet (~7.6 m) and about 60 feet (~18 m). As a specific, nonlimiting example, the shortest distance $d_1$ between the sensor module 132 and the coring bit 104 may be, for example, between about 25 feet (~7.6 m) and about 30 feet (~9.1 m).

In some embodiments, the sensor module 132 may be operatively connected to a downhole communication system 140 configured to transmit the data generated by the sensor module 132. For example, the downhole communication system 140 may be located in the housing 134 with the sensor module 132, within the sensor module 132 itself, in another portion of the coring tool 100 (e.g., above the swivel assembly 122), or in a sub connected directly to the coring tool 100 or distanced from the coring tool 100 by one or more intervening components (e.g., drill collars, a downhole motor, a reamer, a section of drilling pipe, etc.). The downhole communication system 140 may transmit the data generated by the sensor module 132 utilizing, for example, a wireline connection, mud-pulse telemetry, etc. The downhole communication system 140 may send the data generated by the sensor module 132 to a surface station while the coring tool 100 is used to procure a core sample, enabling real-time analysis of the dynamic response of the inner barrel 120 during coring and corresponding adjustment of operational parameters (e.g., weight-on-bit, rotational speed, torque, etc.) to mitigate undesirable inner barrel 120 behavior.

In other embodiments, the sensor module 132 may include nontransitory memory 184 (see FIG. 2) configured to store the data generated by the sensor module 132 locally within the sensor module 132 for subsequent extraction and analysis after the coring tool 100 is removed from a wellbore and a coring process is completed. In some embodiments where the sensor module 132 includes the nontransitory memory 184 (see FIG. 2), the sensor module 132 may not be connected to the surface for real-time transmission of data, omitting the downhole communication system 140.

Figure 2:
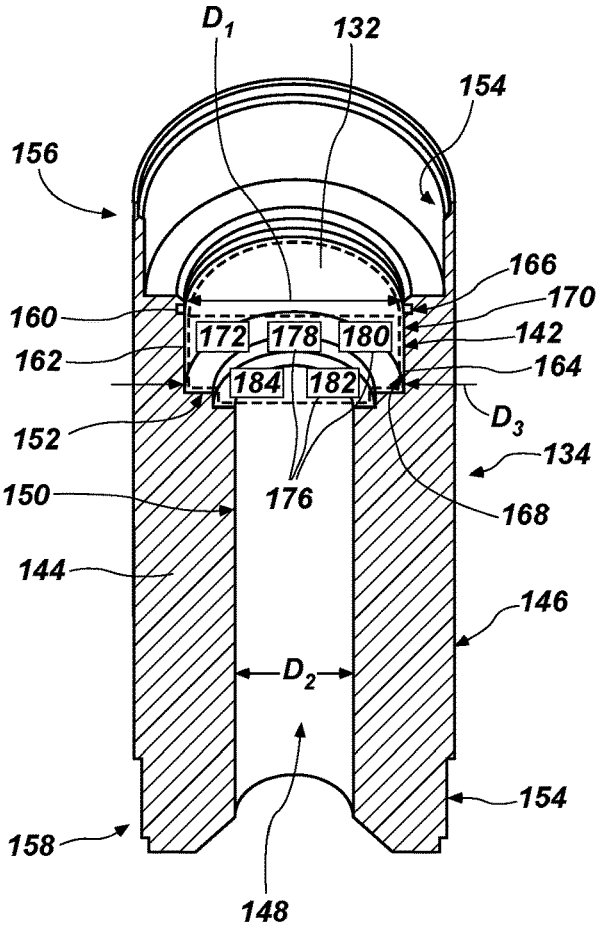
FIG. 2 is a cross-sectional side view of a sensor module in an associated housing of the coring tool of FIG. 1.

FIG. 2 is a cross-sectional side view of the sensor module 132 and associated housing 134 of the coring tool 100 of FIG. 1. The housing 134 may include a generally tubular member, and the sensor module 132 may be retained within a recess 142 in the housing 134. For example, the housing 134 may include a body 144 having a cylindrical outer surface 146, an inner bore 148 extending longitudinally though at least a portion of the body 144 in a direction at least substantially parallel to a direction of flow of drilling fluid along the coring tool 100 (see FIG. 1) during a coring process, and a cylindrical inner surface 150 defining the inner bore 148. The body 144 may include connection portions 154 proximate its longitudinal ends 156 and 158, which are depicted as a threaded box and a threaded pin (e.g., conforming to American Petroleum Institute standards), respectively. The recess 142 may be located proximate to the inner bore 148, and may extend radially outward from a radially innermost portion of the cylindrical inner surface 150 to a radially outermost portion of the cylindrical inner surface 150 to form a ledge 152 located longitudinally between the ends 156 and 158 of the body 144. An average outer diameter $D_1$ of the recess 142 proximate to a first end 156 may be greater than an average outer diameter $D_2$ of the inner bore 148 proximate to a second, opposite end 158 of the body 144 and between the recess 142 and the coring bit 104 (see FIG. 1). More specifically, the average outer diameter $D_1$ of the recess 142 may be, for example, between about 1.25 times and about 3 times the average outer diameter $D_2$ of the inner bore 148. As a specific, nonlimiting example, the average outer diameter $D_1$ of the recess 142 may be between about 1.5 times and about 2 times the average outer diameter $D_2$ of the inner bore 148.

The sensor module 132 may be retained within the recess 142 by at least one of a snap ring 160, an interference fit, a threaded connection 162, and an adhesive material 164. For example, the sensor module 132 may be placed proximate to the ledge 152 within the recess 142, and the snap ring 160 may be positioned partially within an annular groove 166 extending from the recess 142 radially outward into the body 144 to retain the sensor module 132 within the recess 142. As another example, an average outer diameter $D_3$ of the sensor module 132 may be between about 0.1% and about 0.25% smaller than the average outer diameter $D_1$ of the recess 142, and friction between an outer surface 168 of the sensor module 132 and an inner surface 170 of the recess 142 may retain the sensor module 132 within the recess 142. As yet another example, the outer surface 168 of the sensor module 132 and the inner surface 170 of the recess 142 may be complementarily threaded, such that the sensor module 132 may be threadedly engaged with the inner surface 170 of the recess 142. As still another example, an adhesive material 164 may be interposed between the outer surface 168 of the sensor module 132 and the inner surface 170 of the recess 142 to retain the sensor module 132 within the recess 142 by adhesion. As a final example, the sensor module 132 may be retained within the recess 142 by any combination or subcombination of the snap ring 160, interference fit, threaded connection 162, and adhesive material 164.

The sensor module 132 may include a switch 172, which may be configured to activate the sensor module 132 in response to a predetermined triggering condition. For example, the switch 172 may be configured to activate the sensor module 132 in response to a predetermined, detectable, environmental triggering condition or in response to a predetermined, user-initiated triggering condition. More specifically, the switch 172 may include, for example, a temperature sensor, a pressure sensor, or a temperature sensor and a pressure sensor, and may be configured to activate the sensor module 132 when a detected temperature, a detected pressure, or a detected temperature and a detected pressure meet or exceed a predetermined triggering temperature, pressure, or temperature and pressure. As another more specific example, the switch 172 may be operatively connected to a surface control unit 174 (see FIG. 1) configured to accept user inputs (e.g., via a button, switch, knob, keyboard, mouse, etc.) and transmit a signal indicative of the user inputs to the sensor module 132 to activate the sensor module 132. In some embodiments, the switch 172 may also be configured to deactivate the sensor module 132 in response to another predetermined triggering condition. For example, the switch 172 may be configured to deactivate the sensor module 132 in response to another predetermined, detectable, environmental triggering condition or in response to another predetermined, user-initiated triggering condition. More specifically, the switch 172 may be configured to deactivate the sensor module 132 when the detected temperature, the detected pressure, or the detected temperature and the detected pressure meet or fall below another predetermined triggering temperature, pressure, or temperature and pressure. As another more specific example, the switch 172 may deactivate in response to other signals received from the surface control unit 174 (see FIG. 1) indicating of other user inputs.

The sensor module 132 may include, for example, at least one sensor 176 configured to measure one or more properties indicative of the dynamic response of the inner barrel 120 (see FIG. 1) during a coring process. For example, the sensor module 132 may include at least one of an accelerometer 178, a temperature sensor 180, and a magnetometer 182. More specifically, the sensor module 132 may include, for example, any combination or sub combination of the accelerometer 178, the temperature sensor 180, and the magnetometer 182. As a specific, nonlimiting example, the sensor module 132 may include the MultiSense® Dynamics Mapping System, commercially available from Baker Hughes, a GE company of Houston, Tex. By sensing at least the acceleration and magnetic response of the inner barrel 120, and optionally the temperature proximate the sensor module 132, the sensor module 132 may produce data that more accurately reflects the dynamic response of the coring tool 100 (see FIG. 1), and particularly of the inner barrel 120 (see FIG. 1) during a coring process. For example, the sensor module 132 may enable operators and analysts to better understand whether the inner barrel 120 (see FIG. 1) exhibits concentric rotation, exhibits eccentric rotation, makes undesirable contact with an advancing core sample, or otherwise behaves in desirable and undesirable ways during the coring process. Such insights may better enable operators to select and alter operational parameters to mitigate undesirable inner barrel 120 (see FIG. 1) dynamics and increase the likelihood that the inner barrel 120 will exhibit desirable dynamic behavior. As a result, the sensor module 132 and its placement may enable users to procure higher quality core samples.

The sensor module 132 may further include nontransitory memory 184 operatively connected to the one or more sensors 176, the nontransitory memory 184 configured to store the data generated by the sensor module 132 locally within the sensor module 132. For example, the nontransitory memory 184 may include, for example, dynamic, random-access memory (DRAM), static random-access memory (SRAM), erasable programmable read-only memory (EPROM), electrically erasable programmable read-only memory (EEPROM), flash memory, etc. In some embodiments where the sensor module 132 includes nontransitory memory 184, the sensor module 132 may not be connected to the surface for real-time transmission of data, lacking a downhole communication system 140, as described previously in connection with FIG. 1.

Figure 3:
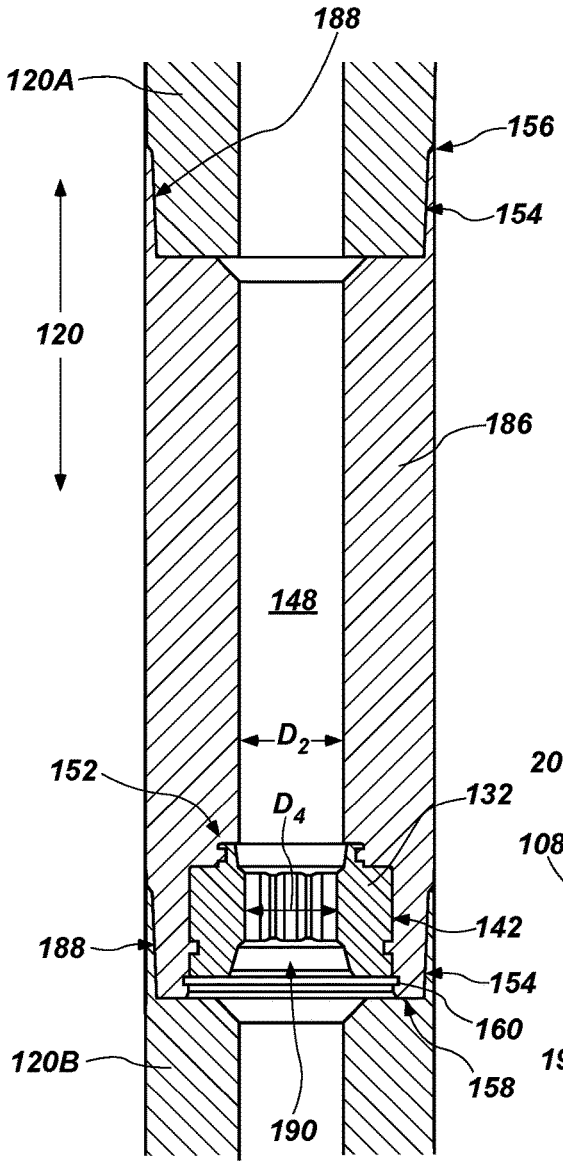
FIG. 3 is a cross-sectional side view of another embodiment of a housing for supporting a sensor module of a coring tool.

FIG. 3 is a cross-sectional side view of another embodiment of a housing 186 for supporting a sensor module 132 of a coring tool 100 (see FIG. 1). In some embodiments, such as that shown in FIG. 3, the sensor module 132 may be located proximate an end 158 of the housing 186 closest to the coring bit 104 (see FIG. 1) and distal from an end 156 of the housing 186 closest to the swivel assembly 122 (see FIG. 1). For example, the recess 142 located proximate an inner bore 148 of the housing 186 may open toward the lower end 158 of the housing 186 when the housing 186 is oriented for lowering into a borehole, and the ledge 152 transitioning from the recess 142 to the outer diameter $D_2$ of the inner bore 148 may be located between a remainder of the recess 142 and the upper end 156 of the housing 186 when the housing 186 is oriented for lowering into a borehole. In such a configuration, the sensor module 132 may rest on, and be supported by, the snap ring 160, which may be located between the sensor module 132 and the coring bit 104 (see FIG. 1).

In some embodiments, such as that shown in FIG. 3, the housing 186 may not be located proximate to, or be directly connected to, the swivel assembly 122 (see FIG. 1). For example, the housing 186 may be located between two sections 120A and 120B of the inner barrel 120. For example, an upper section 120A of the inner barrel 120 may include a connection portion 188 (e.g., a threaded pin) engaged with a connection portion 154 (e.g., a threaded box) at an end 156 of the housing 186 distal from the recess 142 and the sensor module 132 therein. A lower section 120B of the inner barrel 120 may include a connection portion 188 (e.g., a threaded box) engaged with a connection portion 154 (e.g., a threaded pin) at an end 158 of the housing 186 proximate to the recess 142 and the sensor module 132 therein.

When the housing 186 and sensor module 132 are located between sections 120A and 120B of the inner barrel 120, they may be positioned within the coring tool 100 (see FIG. 1) distal from, and between, each of the swivel assembly 122 (see FIG. 1) and the coring bit 104 (see FIG. 1). For example, the shortest distances $d_1$ and $d_2$ (see FIG. 1) between the sensor module 132 and each of the coring bit 104 (see FIG. 1) and the swivel assembly 122 (see FIG. 1) may be, for example, at least about 25 feet (~7.6 m) to accommodate a length of a core sample received in the inner barrel 120. More specifically, the shortest distances $d_1$ and $d_2$ between the sensor module 132 and each of the coring bit 104 (see FIG. 1) and the swivel assembly 122 (see FIG. 1) may be, for example, between about 25 feet (~7.6 m) and about 60 feet (~18 m). As a specific, nonlimiting example, the shortest distances $d_1$ and $d_2$ between the sensor module 132 and each of the coring bit 104 (see FIG. 1) and the swivel assembly 122 (see FIG. 1) may be, for example, between about 25 feet (~7.6 m) and about 30 feet (~9.1 m).

In embodiments where the housing 186 and sensor module 132 are located between sections 120A and 120B of the inner barrel 120, such as that shown in FIG. 3, the sensor module 132 may include a passageway 190 extending longitudinally through the sensor module 132. The passageway 190 may establish fluid communication between opposite longitudinal ends of the sensor module 132, enabling fluid to flow from the upper section 120A of the inner barrel 120, through the inner bore 148 of the housing 186 and the passageway 190 in the sensor module 132, to the lower section 120B of the inner barrel 120. As a result, the passageway 190 may enable fluid (e.g., presaturation fluid) to be introduced into the inner barrel 120 when preparing for introduction into a wellbore and may enable an advancing core sample to proceed from the lower section 120B of the inner barrel 120, through the passageway 190 in the sensor module 132 and the inner bore 148 of the housing 186, into the upper section 120A of the inner barrel 120.

An average outer diameter $D_4$ of the passageway 190 may be greater than, or at least substantially equal to, the average outer diameter $D_2$ of the inner bore 148 of the housing 186. Because the core sample may be required to advance through the passageway 190 in the sensor module 132 and the inner bore 148 of the housing 186, a maximum diameter of the core sample may be at least substantially equal to, or less than, the average outer diameter $D_2$ of the inner bore 148 and the average outer diameter $D_4$ of the passageway 190.

Figure 4:
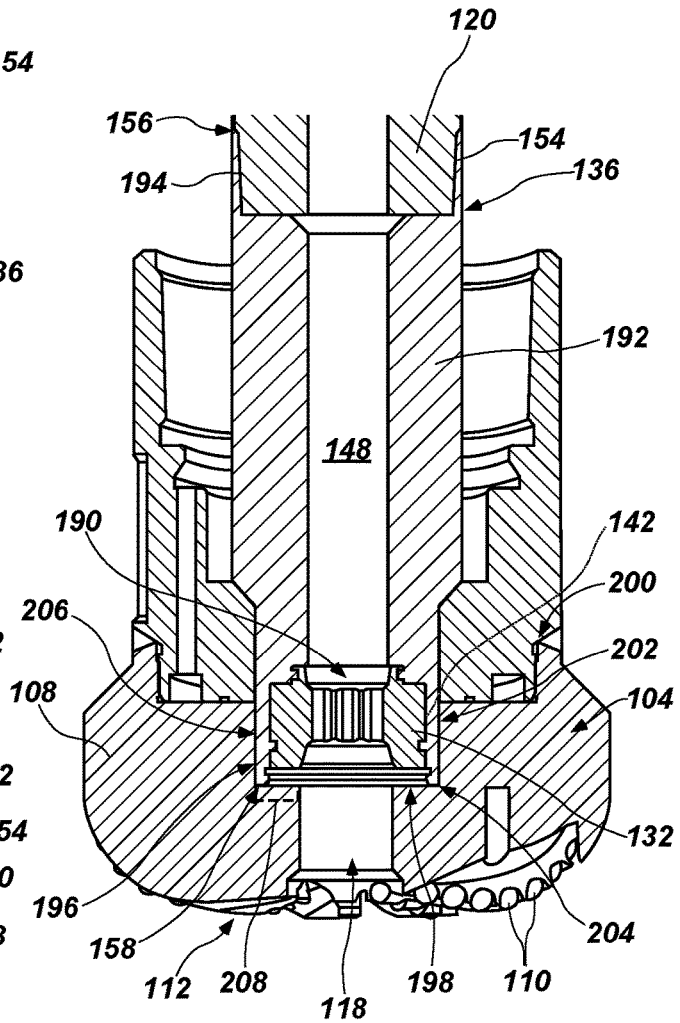
FIG. 4 is a cross-sectional side view of still another embodiment of a housing supporting a sensor module of a coring tool.

FIG. 4 is a cross-sectional side view of still another embodiment of a housing 192 supporting a sensor module 132 of a coring tool. In some embodiments, such as that shown in FIG. 4, the housing 192 may be located, for example, proximate to the coring bit 104. For example, one end 156 of the housing 192 may include a connection portion 154 (e.g., a threaded box) engaged with a corresponding connection portion 194 (e.g., a threaded pin) at the leading end 136 of the inner barrel 120. The recess 142 within which the sensor module 132 may be placed may be located at an end 158 of the housing 192 opposite the inner barrel 120.

The end 158 of the housing 192 may be located at least partially within the bore 118 that extends longitudinally through the body 108 of the coring bit 104. A surface 196 of the body 108 defining the bore 118 may extend radially outward from a radially innermost portion of the bore 118 to a radially outermost portion of the bore 118 to form a ledge 198 located longitudinally between the face 112 and a trailing end 200 of the coring bit 104. The end 158 of the housing 192 may be located at least partially within a recess 202 defined by the ledge 198 and the surface 196 of the body 108 defining the bore 118. In some embodiments, the end 158 of the housing 192 may be longitudinally spaced from the ledge 198 and radially spaced from the surface 196 defining the bore 118, enabling the coring bit 104 to rotate relative to the housing 192, the sensor module 132 supported therein, and the inner barrel 120 connected thereto. For example, a longitudinal standoff 204 between the ledge 198 and the end 158 of the housing 192 may be at least about 1 mm. More specifically, the longitudinal standoff 204 may be, for example, between about 1 mm and about 2 mm when the coring tool 100 (see FIG. 1) is at surface temperature and pressure, which may become between about 2 mm and about 3 mm when the coring tool 100 (see FIG. 1) is subjected to the temperatures and pressures of the downhole environment. As another example, a radial standoff 206 between the surface 196 of the body 108 defining the bore 118 and the end 158 of the housing 192 may be at least about 0.5 mm. More specifically, the radial standoff 206 may be, for example, between about 0.5 mm and about 3 mm when the coring tool 100 (see FIG. 1) is at surface temperature and pressure, which may become between about 1 mm and about 5 mm when the coring tool 100 (see FIG. 1) is subjected to the temperatures and pressures of the downhole environment. In other embodiments, a bearing 208 (e.g., a radial bearing, a thrust bearing, or a radial bearing and a thrust bearing) may be interposed between the housing 192 and the body 108 of the coring bit 104.

When the housing 192 and sensor module 132 are located proximate to the coring bit 104, they may be positioned within the coring tool 100 (see FIG. 1) distal from the swivel assembly 122 (see FIG. 1). For example, the shortest distance $d_2$ (see FIG. 1) between the sensor module 132 and the swivel assembly 122 (see FIG. 1) may be, for example, at least about 25 feet (~7.6 m) to accommodate a length of a core sample received in the inner barrel 120. More specifically, the shortest distance $d_2$ between the sensor module 132 and the swivel assembly 122 (see FIG. 1) may be, for example, between about 25 feet (~7.6 m) and about 60 feet (~18 m). As a specific, nonlimiting example, the shortest distance $d_2$ between the sensor module 132 and the swivel assembly 122 (see FIG. 1) may be, for example, between about 25 feet (~7.6 m) and about 30 feet (~9.1 m).

In embodiments where the housing 192 and sensor module 132 are located proximate to the coring bit 104, such as that shown in FIG. 4, the sensor module 132 may include a passageway 190 extending longitudinally through the sensor module 132. The passageway 190 may establish fluid communication between opposite longitudinal ends of the sensor module 132, enabling fluid to flow from the bore 118 extending through the body 108 of the coring bit 104, through the passageway 190 in the sensor module 132 and the inner bore 148 of the housing 192, to the inner barrel 120. As a result, the passageway 190 may enable an advancing core sample to proceed from the coring bit 104, through the passageway 190 in the sensor module 132 and the inner bore 148 of the housing 192, into the inner barrel 120.

The average outer diameter $D_4$ of the passageway 190 may be greater than, or at least substantially equal to, the inner gage 116 of the coring bit 104. Because the core sample may be required to advance through the passageway 190 in the sensor module 132 and the inner bore 148 of the housing 192, a maximum diameter of the core sample may be at least substantially equal to, or less than, the average outer diameter $D_2$ of the inner bore 148 and the average outer diameter $D_4$ of the passageway 190.

While various features have been shown in connection with specific embodiments in FIGS. 1 through 4, features from different embodiments that are logically combinable with one another may actually be combined to produce embodiments within the scope of this disclosure. For example, housings 186 and 192 including recesses 142 at ends 158 closer to the coring bit 104 may be positioned proximate to the swivel assembly 122, and housings 134 having recesses 142 at ends 156 proximate to the swivel assembly 122 may be positioned between sections 120A and 120B of the inner barrel 120 or proximate to the coring bit 104, and sensor modules 132 having passageways extending therethrough may be positioned in recesses 142 at ends 156 of housings 134 proximate to the swivel assembly 122.

Additional, nonlimiting embodiments within the scope of this disclosure include the following:

Embodiment 1

A coring tool for procuring a core sample from an earth formation, comprising: an inner barrel; an outer barrel located around, and rotatable with respect to, the inner barrel; a coring bit affixed to an end of the outer barrel; and a sensor module rotationally secured to the inner barrel, the sensor module comprising: at least one sensor configured to measure a dynamic response of the inner barrel during a coring process; and a nontransitory memory operatively connected to the at least one sensor, the nontransitory memory configured to store data generated by the at least one sensor.

Embodiment 2

The coring tool of Embodiment 1, wherein the sensor module is located proximate to an end of the inner barrel located opposite the coring bit.

Embodiment 3

The coring tool of Embodiment 2, wherein a shortest distance between the sensor module and the coring bit is at least about 25 feet (~7.6 m).

Embodiment 4

The coring tool of Embodiment 2 or Embodiment 3, wherein the sensor module is supported in a housing affixed to an end of the inner barrel opposite the coring bit.

Embodiment 5

The coring tool of Embodiment 4, wherein the sensor module is retained within a recess in the housing, the recess having a larger average outer diameter than an average outer diameter of a bore extending through the housing between the recess and the coring bit.

Embodiment 6

The coring tool of Embodiment 5, wherein the sensor module is retained within the recess by at least one of a snap ring, an interference fit, a threaded connection, and an adhesive material.

Embodiment 7

The coring tool of any one of Embodiments 4 through 6, further comprising a swivel assembly rotatably supporting the inner barrel within the outer barrel, and wherein the housing is interposed between, and directly secured to, the swivel assembly and the inner barrel.

Embodiment 8

The coring tool of Embodiment 1, wherein the sensor module is located proximate to the coring bit.

Embodiment 9

The coring tool of Embodiment 8, wherein the sensor module comprises a passageway extending longitudinally through the sensor module.

Embodiment 10

The coring tool of Embodiment 8 or Embodiment 9, wherein the sensor module is supported in a housing affixed to an end of the inner barrel proximate to the coring bit.

Embodiment 11

The coring tool of Embodiment 10, wherein a longitudinal standoff between the housing and the coring bit is at least about 1 mm and wherein a radial standoff between the housing and the coring bit is at least about 0.5 mm.

Embodiment 12

The coring tool of Embodiment 1, wherein the sensor module is supported in a housing affixed to ends of sections of the inner barrel.

Embodiment 13

The coring tool of Embodiment 12, wherein a shortest distance between the sensor module and the coring bit is at least about 25 feet (~7.6 m) and wherein a shortest distance between the sensor module and a swivel assembly from which the inner barrel is supported is at least about 25 feet (~7.6 m).

Embodiment 14

The coring tool of any one of Embodiments 1 through 13, wherein the sensor module comprises a switch configured to activate the sensor module in response to a predetermined triggering condition.

Embodiment 15

The coring tool of any one of Embodiments 1 through 14, wherein the sensor module is operatively connected to a downhole communication system configured to transmit the data generated by the at least one sensor to a surface while the coring tool is used to procure the core sample.

Embodiment 16

The coring tool of any one of Embodiments 1 through 15, wherein the at least one sensor comprises at least one of an accelerometer, a temperature sensor, and a magnetometer.

Embodiment 17

A method of making a coring tool for procuring a core sample from an earth formation, the method comprising: placing an inner barrel within an outer barrel, and rendering the outer barrel rotatable with respect to the inner barrel; affixing a coring bit to an end of the outer barrel; and rotationally securing a sensor module to the inner barrel, the sensor module comprising: at least one sensor configured to measure a dynamic response of the inner barrel during a coring process; and a nontransitory memory operatively connected to the at least one sensor, the nontransitory memory configured to store data generated by the at least one sensor.

Embodiment 18

The method of Embodiment 17, further comprising placing the sensor module proximate to an end of the inner barrel located opposite the coring bit.

Embodiment 19

The method of Embodiment 18, wherein placing the sensor module proximate to the end of the inner barrel comprises rendering a shortest distance between the sensor module and the coring bit at least about 25 feet (~7.6 m).

Embodiment 20

The method of Embodiment 18 or Embodiment 19, further comprising supporting the sensor module in a housing affixed to an end of the inner barrel opposite the coring bit.

Embodiment 21

The method of Embodiment 20, wherein supporting the sensor module in the housing comprises retaining the sensor module within a recess in the housing, the recess having a larger average outer diameter than an average outer diameter of a bore extending through the housing between the recess and the coring bit.

Embodiment 22

The method of Embodiment 21, wherein retaining the sensor module within the recess in the housing comprises retaining the sensor module within the recess by at least one of a snap ring, an interference fit, a threaded connection, and an adhesive material.

Embodiment 23

The method of any one of Embodiments 20 through 22, wherein rendering the outer barrel rotatable with respect to the inner barrel comprises rotationally supporting the inner barrel from a swivel assembly within the outer barrel, and further comprising placing the housing between, and directly securing the housing to, the swivel assembly and the inner barrel.

Embodiment 24

The method of Embodiment 17, further comprising supporting the sensor module in a housing and affixing the housing to ends of sections of the inner barrel.

Embodiment 25

The method of Embodiment 17, further comprising placing affixing a housing supporting the sensor module proximate to an end of the inner barrel located opposite proximate to the coring bit.

Embodiment 26

The method of any one of Embodiments 17 through 25, further comprising selecting the sensor module to include a switch configured to activate the sensor module in response to a predetermined triggering condition.

Embodiment 27

The method of any one of Embodiments 17 through 25, further comprising operatively connecting the sensor module to a downhole communication system configured to transmit the data generated by the at least one sensor to a surface while the coring tool is used to procure the core sample.

Embodiment 28

The method of any one of Embodiments 17 through 25, further comprising selecting the at least one sensor to include at least one of an accelerometer, a temperature sensor, and a magnetometer.

Embodiment 29

A method of measuring a dynamic response of at least a portion of a coring tool when procuring a core sample from an earth formation, the method comprising: rotating an outer barrel with respect to an inner barrel; advancing a coring bit located at an end of the outer barrel into an underlying earth formation; receiving at least a portion of a core sample within the inner barrel; and measuring a dynamic response of the inner barrel utilizing a sensor module rotationally secured to the inner barrel, the sensor module comprising: at least one sensor configured to measure a dynamic response of the inner barrel during a coring process; and a nontransitory memory operatively connected to the at least one sensor, the nontransitory memory configured to store data generated by the at least one sensor.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A coring tool for procuring a core sample from an earth formation, comprising:

an inner barrel;

an outer barrel located around, and rotatable with respect to, the inner barrel;

a swivel assembly rotatably supporting the inner barrel within the outer barrel;

a coring bit affixed to an end of the outer barrel; and a sensor module secured to, and rotatable with, the inner barrel, each component of the sensor module being suspended from the swivel assembly, the sensor module comprising:

at least one sensor configured to measure a dynamic response of the inner barrel including rotation of the inner barrel during a coring process; and a nontransitory memory operatively connected to the at least one sensor, the nontransitory memory configured to store data generated by the at least one sensor;

wherein the sensor module is supported in a housing affixed to an end of the inner barrel opposite the coring bit and wherein the sensor module is retained within a recess in the housing, the recess having a larger average outer diameter than an average outer diameter of a bore extending through the housing between the recess and the coring bit.

2. The coring tool of claim 1, wherein the sensor module is located proximate to an end of the inner barrel located opposite the coring bit.

3. The coring tool of claim 2, wherein a shortest distance between the sensor module and the coring bit is between about 25 feet (~7.6 m) and about 60 feet (~18 m).

4. The coring tool of claim 1, wherein the sensor module is retained within the recess by at least one of a snap ring, an interference fit, a threaded connection, and an adhesive material.

5. The coring tool of claim 1, wherein the housing is interposed between, and directly secured to, the swivel assembly and the inner barrel.

6. The coring tool of claim 1, wherein the sensor module comprises a switch configured to activate the sensor module in response to a predetermined triggering condition.

7. The coring tool of claim 1, wherein the sensor module is operatively connected to a downhole communication system configured to transmit the data generated by the at least one sensor to a surface while the coring tool is used to procure the core sample.

8. The coring tool of claim 1, wherein the at least one sensor comprises at least one of an accelerometer, a temperature sensor, and a magnetometer.

9. A method of making a coring tool for procuring a core sample from an earth formation, the method comprising:

placing an inner barrel within an outer barrel, and rotatably supporting the inner barrel within the outer barrel utilizing a swivel assembly;

affixing a coring bit to an end of the outer barrel; and securing a sensor module to the inner barrel, the sensor module rotatable with the inner barrel, each component of the sensor module being suspended from the swivel assembly, the sensor module comprising:

at least one sensor configured to measure a dynamic response of the inner barrel including rotation of the inner barrel during a coring process; and a nontransitory memory operatively connected to the at least one sensor, the nontransitory memory configured to store data generated by the at least one sensor;

wherein securing the sensor module to the inner barrel comprises supporting the sensor module in a housing affixed to an end of the inner barrel opposite the coring bit and retaining the sensor module within a recess in the housing, the recess having a larger average outer diameter than an average outer diameter of a bore extending through the housing between the recess and the coring bit.

* * * * *